US006120730A

United States Patent [19]

Palaniappan et al.

[11] Patent Number: 6,120,730

[45] Date of Patent: Sep. 19, 2000

[54] HEAT AND HYDROGEN PEROXIDE GAS STERILIZATION OF CONTAINER

[75] Inventors: Sevugan Palaniappan, Grayslake; Ronald Swank, Crystal Lake, both of Ill.

[73] Assignee: Tetra Laval Holdings & Finance, SA, Pully, Switzerland

[21] Appl. No.: 09/105,523

[22] Filed: Jun. 26, 1998

[51] Int. Cl.[7] ..... A61L 2/20; B65B 55/10

[52] U.S. Cl. ..... 422/28; 422/302; 422/304; 53/167; 53/426

[58] Field of Search ..... 422/28, 302, 298, 422/304; 53/426, 167

[56] References Cited

U.S. PATENT DOCUMENTS

| | | | |
|---|---|---|---|
| 4,797,255 | 1/1989 | Hatanaka et al. | 422/28 |
| 4,944,132 | 7/1990 | Carlsson et al. | 422/24 X |
| 4,992,247 | 2/1991 | Foti | 422/304 |
| 5,114,670 | 5/1992 | Duffey | 422/24 |
| 5,129,212 | 7/1992 | Duffey et al. | 422/24 X |
| 5,178,841 | 1/1993 | Vokins et al. | 422/304 X |
| 5,213,759 | 5/1993 | Castberg et al. | 422/24 |
| 5,251,423 | 10/1993 | Turtschan | 53/426 |
| 5,368,828 | 11/1994 | Carlson | 422/300 |
| 5,660,100 | 8/1997 | Spelten et al. | 99/356 |
| 5,857,309 | 1/1999 | Cicha et al. | 53/167 |

OTHER PUBLICATIONS

"Easy, Handy, Economic" (The new filling machine generation)—Combibloc, prior art.

"The Filling Machine Range"—Combibloc, prior art.

*Primary Examiner*—Elizabeth McKane

*Attorney, Agent, or Firm*—Welsh & Latz, Ltd.

[57] ABSTRACT

The present invention discloses a method and apparatus for sterilizing containers with gas-phase hydrogen peroxide and heat on a linear form, fill and seal packaging machine. A partially formed container is subjected to multiple applications of gaseous hydrogen peroxide and hot air within a sterilization tunnel. The sterilization tunnel is maintained at a temperature greater than the condensation temperature of hydrogen peroxide. The present invention sterilizes the container allowing for filling of the container with a high acid product such as orange juice for ambient distribution. The container may be any number of possibilities such as TETRA REX® gable top cartons, plastic bottles, and the like. The invention allows for the efficacious use of hydrogen peroxide gas having a concentration of up to 53%.

21 Claims, 5 Drawing Sheets

HEAT AND HYDROGEN PEROXIDE GAS STERILIZATION OF CONTAINER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to sterilization of containers. Specifically, the present invention relates to an apparatus and method for the sterilization of containers using multiple applications of heat and hydrogen peroxide gas within a sterilization tunnel.

2. Description of the Related Art

Milk or juice is often packaged in containers that have been sterilized to prolong shelf life of the contents under refrigeration. When milk or juice is being packaged under aseptic packaging conditions, the contents are capable of being stored for a substantial period of time at room temperature without spoilage. Such packaging processes require effective sterilization of the packaging material prior to filling of a container formed from the packaging material. For example, a container, such as a gable-top carton, that has previously been partially formed may have its interior surfaces sterilized prior to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

A popular type of packaged product is an Extended Shelf Life ("ESL") packaged product due to the added value such a filled container presents to a retailer. For example, pasteurized milk processed and packaged under typical conditions has a shelf life at four degrees Celsius of seven to fourteen days while the same milk processed and packaged under ESL conditions has a shelf life of fourteen to sixty days. Under ESL conditions, juice may have a shelf life of forty to one-hundred twenty days, liquid eggs sixty to ninety days, and eggnog forty-five to sixty days. Thus, ESL packaging greatly enhances a product since it extends the time period that the particular product may be offered for sale to the consuming public. In order to have ESL filling, the filling system should be kept sterile in order to prevent contamination of the product or container during filling on a form, fill and seal package machine.

Many ESL machines use UV light and hydrogen peroxide. However, UV lamps greatly increase the price of a packaging machine and require extensive monitoring and maintenance to operate properly.

Another problem with current sterilization practices is the limitation of concentration of hydrogen peroxide that may be used on packaging material for food. Only a minute quantity of hydrogen peroxide residue may be found on the packaging that limits most applications to less than 1% concentration, and requiring UV light. However, as mentioned above, UV lamps and associated components are very expensive and require more maintenance and energy than machines without UV lamps.

Another popular type of packaged product is an aseptic packaged product due to the tremendous value such a filled container presents to a retailer. For example, ultra high temperature processed milk may have a non-refrigerated shelf life of over one-year in a TETRA BRIK® Aseptic package. Such a package is fabricated from a web of packaging material on a vertical form, fill and seal packaging machine that is substantially enclosed except for an outlet for the final package. It is quite apparent that producing a package capable of non-refrigerated distribution is highly desirable, however, the packaging machine must be substantially enclosed to prevent any and all contamination of the product, the machine or the packaging material.

In the area of aseptic linear form, fill and seal packaging machines, wherein a series of container blanks are utilized instead of a web of packaging material, the maintenance of the entire machine in a non-contaminated enclosed environment is highly critical. One such machine is disclosed in U.S. Pat. No. 5,660,100 wherein a preheating zone, a sterilizing zone, a drying zone, a filling zone and a closure zone are all enclosed within a single sterile space that optimizes hermeticity. A hydrogen peroxide aerosol or liquid is utilized to sterilize the packages and the enclosure. As is apparent, the hermetically sealed environment is the most important factor in maintaining the aseptic environment. Such an environment increases the price of the machine and requires substantial maintenance.

Another machine is disclosed in U.S. Pat. No. 4,992,247 wherein a container sterilization system is adaptable to a form, fill and seal machine. The system is a closed loop system having a chamber, a blower for directing a mixture of air, vaporized hydrogen peroxide and vaporized water through ductwork and to a vapor delivery inlet manifold disposed above a line of conveyors conveyed therethrough the system. An exhaust manifold is positioned below the containers to receive the mixture. An iso-box is positioned at the front of the inlet manifold to serve as an air lock or curtain to prevent outside contaminants from entering the chamber and to prevent vaporized hydrogen peroxide from leaving the chamber. Containers enter the iso-box before entering the chamber. In the chamber, hydrogen peroxide condenses on the inner surfaces of each of the containers prior to exiting through another iso-box. As each container moves through the chamber, liquid hydrogen peroxide condenses on inner surfaces and eventually an equilibrium is reached between the liquid and vapor hydrogen peroxide. The pre-heating temperatures and the processing temperatures are controlled to maintain the sterilizing effect. After the iso-box is a drying air inlet manifold having heated air flowing from a HEPA filter. Although U.S. Pat. No. 4,992,247 discloses that the system is positioned between a bottom forming station and a top sealing station, it is assumed that a filling station is disposed adjacent the drying manifold. It is important in U.S. Pat. No. 4,992,247 that the hydrogen peroxide condense on the containers in order to have the desired "scrubbing" effect.

An ESL machine is capable of producing a large number of containers per hour of operation and allows for an "open" operating environment as compared to an aseptic machine that requires a substantially enclosed environment for most of the machine to prevent contamination of the packaging material, product and machinery. However, the aseptic container is capable of non-refrigerated storage for long periods of time. In the sterilized package stage, positioned between ESL packages and aseptic packages, are high acid ambient distribution ("HAAD") packages. The HAAD package is capable of non-refrigerated storage, however, the product must have a minimum acidity (pH less than 4.6) such as the acidity of orange juice (pH 2.8) as compared to the acidity of milk (pH 6.9) which is an unacceptable product for a HAAD package. What is needed is a way of producing a HAAD container on a linear form, fill and seal packaging machine without major modification of the machine.

BRIEF SUMMARY OF THE INVENTION

The present invention provides a solution to the need for a machine capable of producing a HAAD container without major modification of a linear form, fill and seal packaging machine. The present inventions provides a modification to current ESL machines that allows for the production of a HAAD container without having to substantially enclose the entire packaging machine.

One aspect of the present invention is a sterilization apparatus for use on a packaging machine. The sterilization apparatus has a conveyor assembly and a sterilization tunnel encompassing a portion of the conveyor assembly. There is a plurality of gas nozzles disposed inside the sterilization tunnel for emitting hydrogen peroxide gas onto each of the cartons as the cartons are conveyed underneath the nozzles. There is also a plurality of heaters for flowing heated air onto the cartons subsequent to application of hydrogen peroxide gas from a corresponding nozzle.

Another aspect of the invention is a method for sterilizing cartons on a packaging machine. The method includes moving the cartons into a sterilization tunnel, applying hydrogen peroxide gas, heating the cartons, applying another dose of hydrogen peroxide gas, applying a third dose of hydrogen peroxide gas, then heating the cartons before moving the cartons from the sterilization tunnel.

Yet another aspect of the invention is a packaging machine having a conveyor assembly, a sterilization tunnel and a filling station. The sterilization tunnel has a plurality of vapor nozzles and a plurality of heaters for sterilizing cartons being conveyed through the tunnel. At the filling station a high acid product is filled into each of the cartons. A slight derivation of this aspect of the invention includes a dual indexing processing line wherein two cartons are simultaneously transported by the conveyor assembly. Thus, each gas nozzle is divided into two sub-nozzles for applying hydrogen peroxide gas to both cartons simultaneously. Further, the heaters are divided and the filling station has two fill pipes for filling two cartons simultaneously.

Yet another aspect of the invention is using ionized air that is mixed with the hydrogen peroxide gas and also ionized air for the heaters.

It is a primary object of the present invention to provide a method and apparatus for providing a high acid ambient distribution product in a carton.

It is an additional object of the present invention to provide a method and apparatus for sterilizing cartons on a form, fill and seal packaging machine using multiple applications of gaseous hydrogen peroxide and heat.

It is yet an additional object of the present invention to provide a method and apparatus for sterilizing cartons using hydrogen peroxide gas having a concentration upwards to 53%.

Having briefly described this invention, the above and further objects, features and advantages thereof will be recognized by those skilled in the pertinent art from the following detailed description of the invention when taken in conjunction with the accompanying drawings.

DETAILED DESCRIPTION OF THE INVENTION

A common form of container for milk or juice is the gable top carton although some cartons no longer have a gable top. The carton has a paperboard substrate with a plastic (usually polyethylene) coating on the inside and the outside that enables the top of the carton to be closed and sealed after filling. Gable top cartons, standard or modified, are usually fabricated on a linear, multiple station, form, fill and seal packaging machine. An example of such a machine is the TR/18™ TETRA REX® packaging machine available from Tetra Pak, Inc. of Chicago, Ill.

Other types of containers that are partially formed and have an open top before filling include, plastic bottles such as polyethylene terephthalate (PET) bottles and blow molded polyethylene bottles. Yet other types of containers include the TETRA TOP® package available from Tetra Pak.

Figure 1:
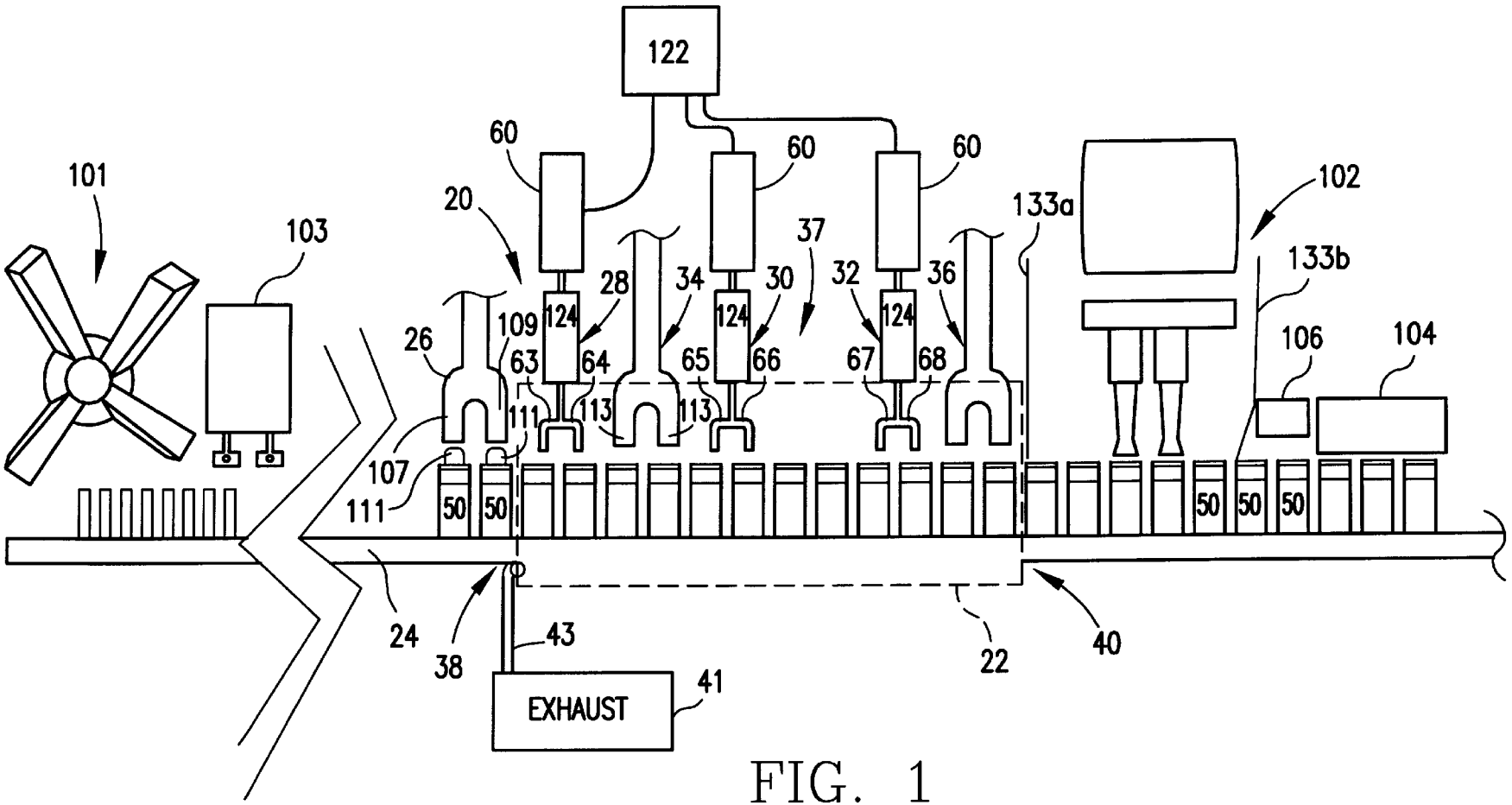
FIG. 1 is a schematic side view of the conveyor line of a packaging machine integrated with the sterilization apparatus of the present invention.
Figure 2:
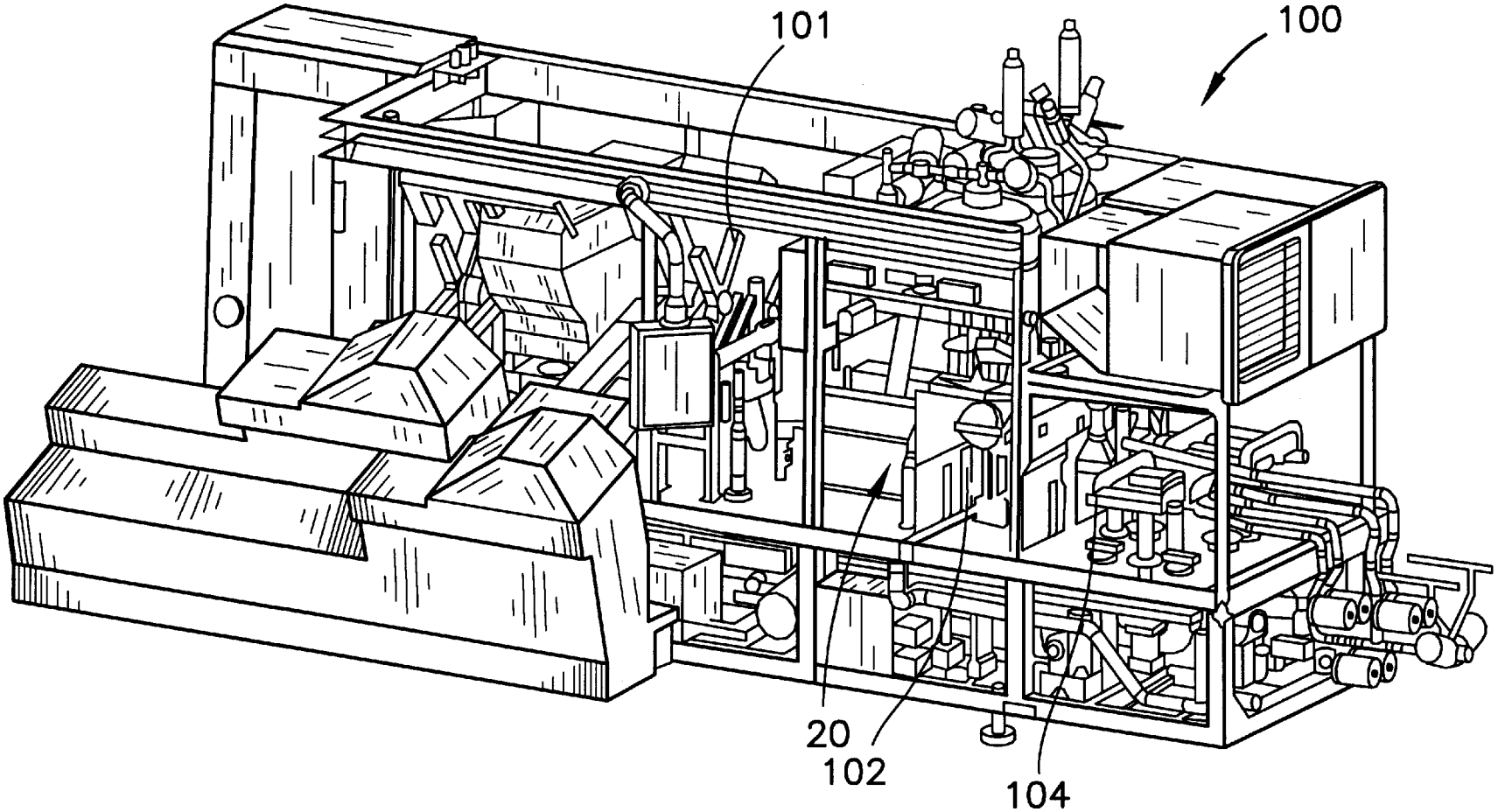
FIG. 2 is a top perspective view of a dual line, dual processing packaging machine integrated with the sterilization apparatus of the present invention.
Figure 3:
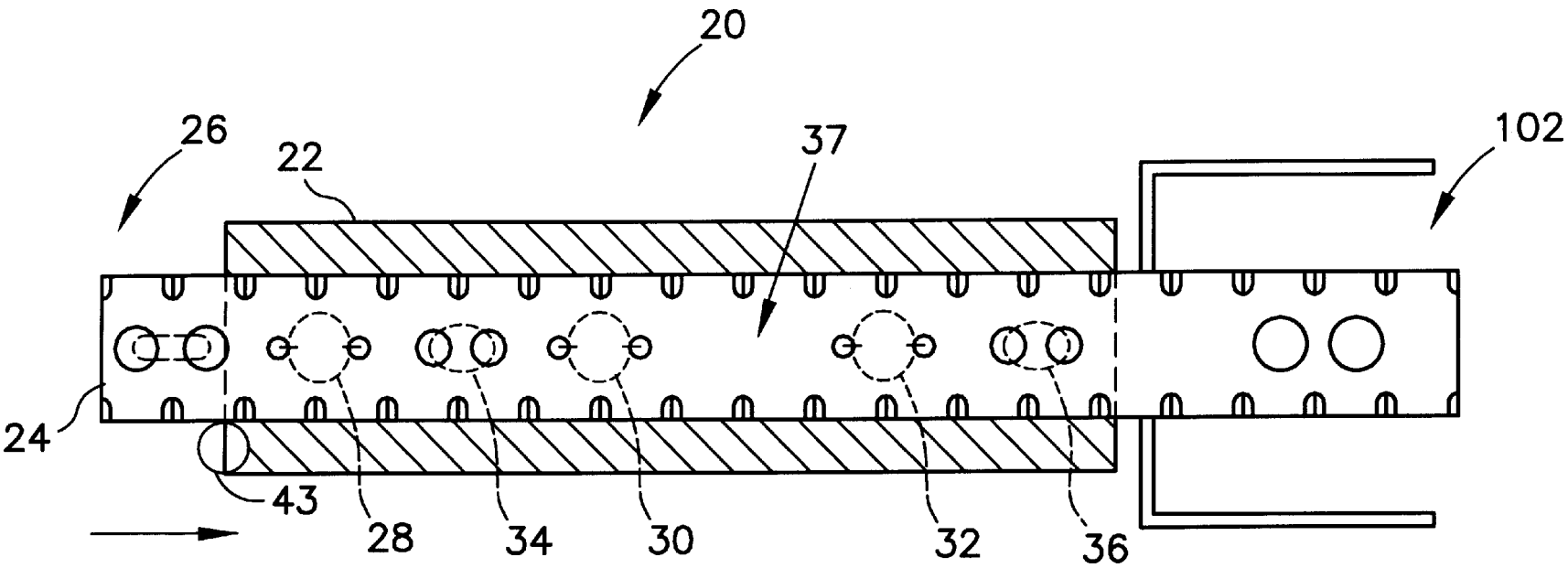
FIG. 3 is a top plan view of the sterilization apparatus of the present invention.

Referring to FIGS. 1 and 2, the sterilization apparatus 20 is schematically shown on a packaging machine 100. The packaging machine may have a bottom forming station 101 that receives the containers 50 in an erected state. The bottom forming station 101 will heat, fold and seal the bottom of the container 50 to produce an open-top container with sidewalls and a sealed bottom. The open top container 50 is placed on a conveyor system 24 for conveyance at a predetermined interval (indexing) to the right as viewed in FIG. 2. The containers 50 are placed equidistant apart and advance a predetermined number of carton positions during each periodic advancing step of the conveyor. Between each advancing step of the conveyor 24, the containers 50 generally remain stationary for processing for the predetermined interval. The predetermined interval usually corresponds to the slowest process on the line in the fabrication of the carton. The slowest process is usually the sealing of the top of the container 50 after filling with a desired product. A container 50 will wait for the predetermined interval, then proceed toward the next station.

The containers 50 may then proceed to an optional fitment applicator station 103. Other machines may not have a fitment applicator, or may apply the fitment post-processing. In such situations, the containers 50 will proceed directly to the sterilization apparatus 20. If a fitment is applied, various applicators may be employed. One such applicator is described in U.S. patent application Ser. No. 08/710,619 filed on Sep. 20, 1996 for a Process And Apparatus For Applying Fitments To A Carton which is hereby incorporated by reference.

The containers 50 then proceed to the sterilization apparatus 20. The sterilization apparatus 20 is positioned between the bottom forming station 101 and the filling station 103, and is generally composed of a sterilization tunnel 22, that encompasses a portion of the conveyor assembly 24 and a pre-folding/heating station 26. The sterilization tunnel has a series of hydrogen peroxide gas stations and heater/hot air stations disposed above the conveyor assembly 24 to perform several actions on each container 50 as it is conveyed below. The tunnel 22 has an ingress 38 from which containers 50 enter, and an egress 40 from which containers 50 exit the tunnel 22. The ingress 38 and egress 40 are open to the packaging machine 100 that may be closed on its sides for safety, however, it has an open top which is in unobstructed flow with the environment.

The containers 50 are conveyed to a pre-folding/heater station 26. At the station 26, each container 50 is heated to a first pre-determined temperature to prepare the container 50 for application of hydrogen peroxide gas. As shown in the examples below (under pre-heater), the temperature varies from 200° C. to 300° C. At the station 26, the container 50 may also have its top panels pre-folded if the container 50 is a gable-top carton or the like. If, as shown in FIGS. 1 and 2, the packaging machine 100 has a dual processing line wherein two containers 50 are simultaneously processed at each station, then the heating station 26 will have dual hot air blowers 107 and 109 with corresponding pre-folding arms 111.

In an alternative embodiment not shown, the heater station 26 may be placed within the tunnel 22. If the heating station 26 is within the tunnel 22, the open area 37 will be occupied by a hydrogen peroxide gas station or a heater.

After the pre-heating at the heating station 26, the containers 50 are conveyed through the ingress 38 and into the sterilization tunnel 22. The first station inside of the tunnel 22 is the first hydrogen peroxide gas station 28. At the first hydrogen peroxide gas station, each container 50 is subjected to a quantity of gas phase hydrogen peroxide emitted from a gas nozzle 63 and 64 at approximately 190° C. The gas nozzles 63 and 64 continuously emit gas phase hydrogen peroxide at a predetermined rate as opposed to intermittent spraying of the gas in each container as each container 50 pauses at the vaporization station 28. On high production machines (e.g., over 10,000 containers per hour), such intermittent spraying would be impractical. A preferred pre-determined rate is 0.5 liters per hour.

Immediately after the first hydrogen peroxide gas station 28 is the first interior heating station 34. Hot air is blown from blower tubes 113 onto each container 50 as it passes below. The temperature of the heated air may vary from 150° C. to 350° C. Immediately after the first interior heater station 34 is the second hydrogen peroxide gas station 30. Similar to the first hydrogen peroxide gas station 28, the second hydrogen peroxide gas stations 30 subjects each container 50 to a quantity of gas phase hydrogen peroxide continuously emitted from a gas nozzle 65 and 66 at approximately 190° C. After the second hydrogen peroxide gas station 30 is an open area 37, open in that there is no action performed on the containers 50 at this "station". However, in other embodiments, the open area 37 may have an optional heater station similar to the first interior heater 34.

The next station is the third hydrogen peroxide gas station 32. Similar to the first and second hydrogen peroxide gas stations 28 and 30, the third hydrogen peroxide gas stations 32 subjects each container 50 to a quantity of gas phase hydrogen peroxide continuously emitted from a gas nozzle 67 and 68 at a temperature of approximately 190° C. Subsequent to the third hydrogen peroxide gas station 32 and just before the egress 40 to the tunnel 22, is a second interior heater 36. Similar to the first interior heater 34, hot air is blown from blower tubes 113 onto each container 50 as it passes below. The temperature of the heated air may vary from 200° C. to 300° C. The heaters 34 and 36 act to remove hydrogen peroxide that is applied onto each container 50. The multiple hydrogen peroxide gas application followed by hot air removal thoroughly sterilizes the containers to provide an adequate log reduction of microorganisms for fabrication of a HAAD package/product, as demonstrated by the examples below.

As mentioned previously, the filling station 102 is subsequent to the tunnel 22. The filling station may be partitioned by filling station walls 133*a–b* in order to maintain the hygienic environment during filling. To that end, a microfiltrated air system with High Efficiency Particulate Absolute ("HEPA") filters is provided in the filling station 102. A filling station with such a microfiltrated air system is disclosed in co-pending U.S. patent application Ser. No. 08/828,931, filed on Mar. 28, 1997, entitled Filling Machine Having A Microfiltrated Air Supply System, and hereby incorporated in its entirety by reference. The HEPA air from the filling station 102 flows into the egress 40 of the tunnel 22 thereby providing sterile air into the tunnel 22 and directing the flow of air outward from the ingress 38 of the tunnel 22 to prevent contaminated air from flowing into the ingress 38 and ultimately into the tunnel 22. Further downline from the filling station 102 is an optional pre-breaking station for the top of the carton, if pre-breaking is not accomplished at the pre-heating station 26, and a top sealing station 104 for sealing the top of the containers 50.

An exhaust system 41 may be disposed near the ingress 38 with exhaust inlet 43 positioned for receiving air from the ingress 38 of the tunnel 22. In this manner, the flow of air through the tunnel 22 is directed towards the ingress 38.

Figure 4:
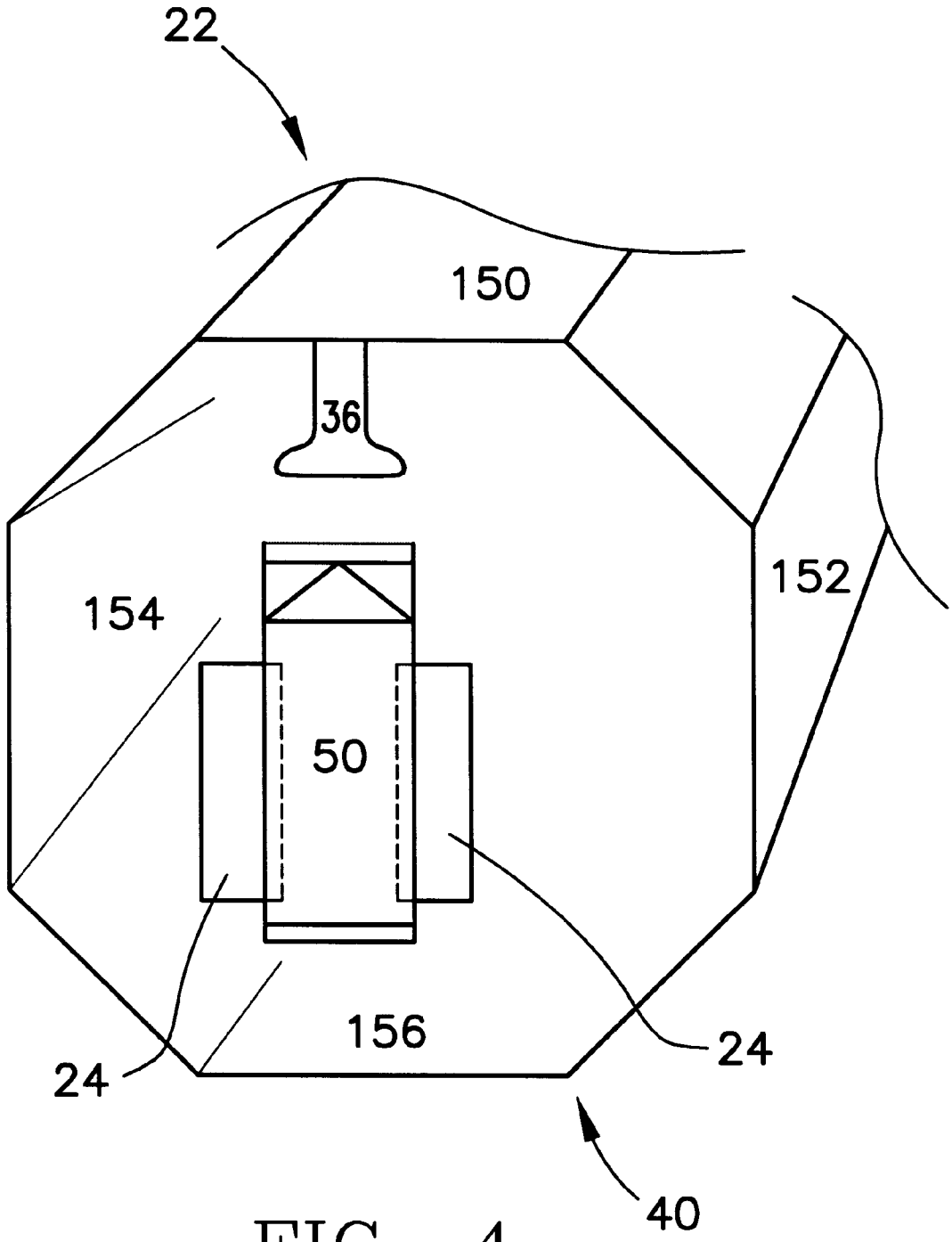
FIG. 4 is an isolated perspective view of the egress of sterilization tunnel of the present invention.

As shown in FIG. 4, the tunnel 22 is generally composed of a ceiling 150, a first side wall 152, a second side wall 154 and a floor 156. The portion of the conveyor assembly 24 that transports containers 50 through the tunnel 22 is in fact itself encompassed within the tunnel 22. The tunnel 22 is usually composed of stainless steel to promote hygiene. The tunnel acts as an extension of the hygienic zone of the filling station 102 and top sealing station 104 in that a sterile environment is maintained within the tunnel 22 in an area that usually would be subject to some contamination. The tunnel is maintained at a temperature that inhibits condensation of the hydrogen peroxide gas. The condensation temperature for hydrogen peroxide at atmospheric pressure is 60° C. A preferred temperature for the tunnel 22 is 140° C.

Figure 5:
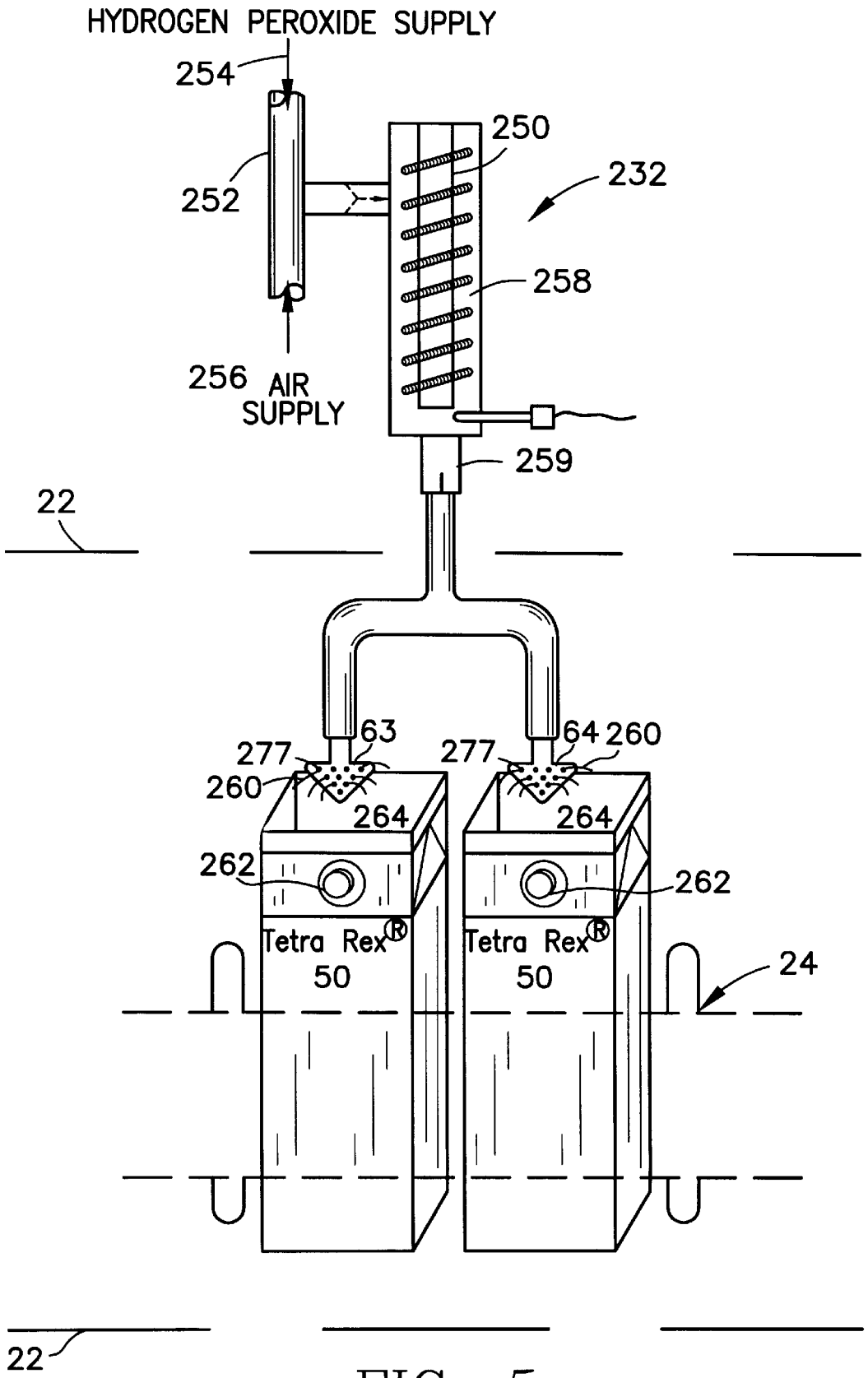
FIG. 5 is an isolated view of the gas delivery system of the present invention.

FIG. 5 shows the gas delivery system of the present invention. The gas delivery system is the same for each of the hydrogen peroxide gas stations 28, 30 and 32. The gas delivery system consists of the gas nozzles and the vaporizer 232. The vaporizer 232 may be a heat exchanger 250 that receives air and hydrogen peroxide through a conduit 252. The conduit 252 is in flow communication with a hydrogen peroxide source 254 and an air supply 256. As the liquid solution of hydrogen peroxide enters the chamber 258 of the vaporizer 232, it is heated to a temperature in excess of 175° C., the vaporization temperature of hydrogen peroxide. In an alternative embodiment, the vaporizer may transform the solution of hydrogen peroxide into gas through increasing the pressure instead of the temperature.

The gas phase hydrogen peroxide flows through a second conduit 259 to the nozzles 63 and 64, in FIG. 5, where it is applied onto a container 50 as illustrated by arrows 260. The nozzles may have a distribution of openings 277 sufficient to widely disperse the gas. When the gas exits the nozzles 63 and 64, its temperature is usually 180–190° C. The flow of hydrogen peroxide is continuous, and varies in the range of 0.25 liters to 1.0 liters per hour.

The hydrogen peroxide gas enters and flows onto the opened interior 264 of the container 50, the exposed exterior of the container 50, and also on an optional fitment 262. As previously stated, the container 50 is stationary for the predetermined interval at each hydrogen peroxide gas station during which a predetermined amount of hydrogen peroxide gas flows onto the containers 50. For example, the predetermined interval may be 1.2 seconds. After application of hydrogen peroxide gas, the container 50 is subject to hot air at the heaters 34 and 36. Obviously, if the open area 37 is not used for a heater, then application of hydrogen peroxide gas at hydrogen peroxide gas station 30 is not followed by hot air application. The hot air distributes the hydrogen peroxide gas from the interior of the container 50 to the exterior.

Of the greatest importance in practicing this present invention are the temperature of the hydrogen peroxide gas, the temperature of the air from the heaters, the temperature of the tunnel and the concentration of the hydrogen peroxide. Although the hydrogen peroxide is set forth as a concentration, for example 35%, the flow rate of hydrogen peroxide may be viewed as a mass to take into account the pressure variations as the gas flows into the tunnel 22 from the gas delivery system 232. For example, a hydrogen peroxide flow rate of 0.5 liters per hour corresponds to 300 grams of hydrogen peroxide per kilogram of air. The present invention contemplates upwards to 500 grams of hydrogen peroxide to kilogram of air.

The present invention will be described in the following examples which will further demonstrated the efficacy of the novel method and apparatus for sterilizing containers on a linear packaging machine, however, the scope of the present invention is not to be limited by these examples.

All of the examples used one-liter TETRA REX® gable top cartons composed of a paperboard material coated on both surfaces with a thermoplastic such as polyethylene. The cartons may also have a barrier layer such as an aluminum layer.

Each carton sample was inoculated by spraying the microorganism onto the interior of the cartons and allowing the cartons to dry overnight. The cartons were in the folded and longitudinal side sealed blank form. The positive controls set forth the amount of colony forming units (CFU) of microorganism. The log average is 6.64 per carton.

The carton samples where run on a TETRA REX® TR/8 model linear dual line form, fill and seal packaging machine. The production speed was approximately 10,000 cartons per hour. The cartons were placed in a magazine, open and erected on a carton opener, bottom formed on a mandrel and placed on a conveyor for conveyance to the sterilization apparatus. The cartons were not filled with a product or top sealed. After sterilization, the sterilized cartons were placed in an airtight container and transported to a laboratory for analysis using the Shake Recovery Method set forth below.

For each of the examples, the gas phase hydrogen peroxide had a concentration of 35%. As listed in the Tables, the "Pre-Heater" or "Heater #1" corresponds to heating station 26, as shown on FIG. 1. The "Heater #2" corresponds heating station 34. The "H2O2 #1" corresponds to hydrogen peroxide gas station 28. The "H2O2 #2" corresponds to hydrogen peroxide gas station 30. The "H2O2 #3" corresponds to hydrogen peroxide gas station 32. The "Heater #3" corresponds heating station 36. The chamber temperature is indicative of the temperature of the sterilization tunnel 22.

The log reduction corresponds to the amount of microorganisms killed and demonstrates the effectiveness of the sterilization apparatus and method. The test organism for all of the Examples was *Bacillus subtilis* var *niger*.

The positive controls establish the baseline of contamination for each of the examples. For a positive control test, the inoculated containers are processed through a linear packaging machine without any form of sterilization. Thus, each container is not pre-heated, or vaporized or provided with hot air removal. Each container is only placed on the conveyor chain from a bottom forming station, and conveyed through the sterilization tunnel, without filling or top sealing.

The air pressure of the heated air may vary from 1 inch to 12 inches on a water column.

Shake Recovery Method

This method is used as a recovery method when the entire inside of the carton needs to be sampled.

1. All test procedures performed under a laminar flow hood.
2. Aseptically add 100 ml of sterile rinsing fluid (0.1% peptone, 0.05% Tween 80 and DI water) and sterile glass beads.
3. Clamp carton securely at the top with vice grips and shake as follows:
   Shake 10 times up and down
   Rotate ½ turn
   Shake 10 times up and down
   Turn carton side ways
   Shake 10 times side to side
   Rotate ½ turn
   Shake 10 times side to side
   Turn carton up right
   Shake 10 times up and down
   Rotate ½ turn
   Shake 10 times up and down
4. Remove sample and plate appropriate dilutions
   Test Samples: Plate dilution $10^{-1}$ (10 ml in 15×150 mm plate) and $10^{-2}$ (1 ml in 15×100 mm plate) in duplicate
   Positive Controls: Plate dilutions $10^{-3}$, $10^{-4}$, and $10^{-5}$ in duplicate.
   Negative Controls: Plate the 10–1 dilution (10 ml in 15×150 mm plate) in duplicate.
5. Pour plates using Plate Count Agar and incubate at 32° C. for 48 hours.
6. After incubation, record all results.

EXAMPLE ONE

For Example One, four different variables of the apparatus and method are set forth in Tables two through five. Table One illustrates the results for the Positive Control for Example One.

TABLE ONE

| | | Positive Controls | | | |
|---|---|---|---|---|---|
| Sample # | Variable | Result 1 | Result 2 | CFU/Carton | Log |
| 1 | PC 5/1/98 | 4.10E+06 | 4.00E+06 | 4050000 | 6.61 |
| 2 | PC 5/1/98 | 5.50E+06 | 5.30E+06 | 5400000 | 6.73 |
| 3 | PC 5/1/98 | 5.60E+06 | 4.20E+06 | 4900000 | 6.69 |

TABLE ONE-continued

| Sample # | Variable | Positive Controls Result 1 | Result 2 | CFU/Carton | Log |
|---|---|---|---|---|---|
| 4 | PC 5/1/98 | 4.30E+06 | 3.50E+06 | 3900000 | 6.59 |
| 5 | PC 5/1/98 | 3.20E+06 | 4.70E+06 | 3950000 | 6.60 |
| | | | | Average | 6.64 |
| | | | | Stdev | 0.06 |

Air Velocity for Heaters = 470 wherein 499 = 17" on a water column.
Residual Levels = 0.1–0.3

TABLE TWO

Variable A:

| | 1 Pre-Heater | 2 Heater #2 | 3 H2O2 #1 | 4 H2O2 #2 | 5 Open | 6 H2O2 #3 | 7 Heater #3 | Tunnel Temp. |
|---|---|---|---|---|---|---|---|---|
| | OFF | 250 C | 190 C | 190 C | — | 190 C | 250 C | — |

Results:

| Sample # | Variable | Result 1 | Result 2 | CFU/Carton | Log | Log Red. |
|---|---|---|---|---|---|---|
| A1 | A | 500 | 590 | 545 | 2.7 | 3.91 |
| A2 | A | 480 | 270 | 375 | 2.6 | 4.07 |
| A3 | A | 310 | 240 | 275 | 2.4 | 4.20 |
| A4 | A | 180 | 180 | 180 | 2.3 | 4.39 |
| A5 | A | 30 | 80 | 55 | 1.7 | 4.90 |
| | | | | | Average | 4.29 |
| | | | | | Stdev | 0.38 |

TABLE THREE

Variable B:

| | 1 Pre-Heater | 2 Heater #2 | 3 H2O2 #1 | 4 H2O2 #2 | 5 Open | 6 H2O2 #3 | 7 Heater #3 | Tunnel Temp. |
|---|---|---|---|---|---|---|---|---|
| | 200 C | 250 C | 190 C | 190 C | — | 190 C | 250 C | — |

Results:

| Sample # | Variable | Result 1 | Result 2 | CFU/Carton | Log | Log Red. |
|---|---|---|---|---|---|---|
| B1 | B | 50 | 30 | 40 | 1.6 | 5.04 |
| B2 | B | 220 | 150 | 185 | 2.3 | 4.38 |
| B3 | B | 60 | 20 | 40 | 1.6 | 5.04 |
| B4 | B | 430 | 290 | 360 | 2.6 | 4.09 |
| B5 | B | 40 | 200 | 120 | 2.1 | 4.56 |
| B6 | B | 1230 | 1980 | 1605 | 3.2 | 3.44 |
| B7 | B | 360 | 280 | 320 | 2.5 | 4.14 |
| B8 | B | 140 | 160 | 150 | 2.2 | 4.47 |
| | | | | | Average | 4.39 |
| | | | | | Stdev | 0.53 |

TABLE FOUR

| Variable C: | | | | | | | | |
|---|---|---|---|---|---|---|---|---|
| | 1 Pre-Heater | 2 Heater #2 | 3 H2O2 #1 | 4 H2O2 #2 | 5 Open | 6 H2O2 #3 | 7 Heater #3 | Tunnel Temp. |
| | OFF | OFF | 190 C | 190 C | — | 190 C | 250 C | 46–129 C |

Results:

| Sample # | Variable | Result 1 | Result 2 | CFU/Carton | Log | Log Red. |
|---|---|---|---|---|---|---|
| C1 | C | 260 | 120 | 190 | 2.3 | 4.36 |
| C2 | C | 430 | 400 | 415 | 2.6 | 4.03 |
| C3 | C | 370 | 380 | 375 | 2.6 | 4.07 |
| C4 | C | 310 | 380 | 345 | 2.5 | 4.11 |
| C5 | C | 390 | 520 | 455 | 2.7 | 3.99 |
| C6 | C | 370 | 290 | 330 | 2.5 | 4.13 |
| C7 | C | 400 | 370 | 385 | 2.6 | 4.06 |
| C8 | C | 400 | 380 | 390 | 2.6 | 4.05 |
| | | | | | Average | 4.10 |
| | | | | | Stdev | 0.12 |

TABLE FIVE

| Variable D: | | | | | | | | |
|---|---|---|---|---|---|---|---|---|
| | 1 Pre-Heater | 2 H2O2 #1 | 3 Heater #2 | 4 H2O2 #2 | 5 Open | 6 H2O2 #3 | 7 Heater #3 | Tunnel Temp. |
| | 200 C | 190 C | 250 C | 190 C | — | 190 C | 250 C | 114–142 C |

Results:

| Sample # | Variable | Result 1 | Result 2 | CFU/Carton | Log | Log Red. |
|---|---|---|---|---|---|---|
| D1 | D | 60 | 10 | 35 | 1.5 | 5.10 |
| D2 | D | 60 | 130 | 95 | 2.0 | 4.67 |
| D3 | D | 10 | 10 | 10 | 1.0 | 5.64 |
| D4 | D | 150 | 110 | 130 | 2.1 | 4.53 |
| D5 | D | 20 | 10 | 15 | 1.2 | 5.47 |
| D6 | D | 40 | 50 | 45 | 1.7 | 4.99 |
| D7 | D | 30 | 10 | 20 | 1.3 | 5.34 |
| D8 | D | 170 | 190 | 180 | 2.3 | 4.39 |
| | | | | | Average | 5.02 |
| | | | | | Stdev | 0.46 |

EXAMPLE TWO

For Example Two, two different variables of the apparatus and method are set forth in Tables Seven and Eight. Table Six illustrates the results for the Positive Control for Example Two.

TABLE SIX

Positive Controls

| Sample # | Variable | Result 1 | Result 2 | CFU/Carton | Log |
|---|---|---|---|---|---|
| 1 | PC 5/4/98 | 2.90E+06 | 3.20E+06 | 3050000 | 6.48 |
| 2 | PC 5/4/98 | 4.20E+06 | 4.70E+06 | 4450000 | 6.65 |
| 3 | PC 5/4/98 | 3.90E+06 | 4.70E+06 | 4300000 | 6.63 |

TABLE SIX-continued

Positive Controls

| Sample # | Variable | Result 1 | Result 2 | CFU/Carton | Log |
|---|---|---|---|---|---|
| 4 | PC 5/4/98 | 4.70E+06 | 4.20E+06 | 4450000 | 6.65 |
| 5 | PC 5/4/98 | 2.70E+06 | 2.80E+06 | 2750000 | 6.44 |
| | | | | Average | 6.57 |
| | | | | Stdev | 0.10 |

Air Velocity for Heaters = 470

Residual Levels = 0.1–0.2

TABLE SEVEN

| Variable A: | | | | | | | | |
|---|---|---|---|---|---|---|---|---|
| | 1 | 2 Heater #1 | 3 H2O2 #1 | 4 Heater #2 | 5 H2O2 #2 | 6 H2O2 #3 | 7 Heater #3 | Tunnel Temp. |
| | OFF | 170 C | 190 C | 200 C | 190 C | 190 C | 250 C | 122–138 C |

Results:

| Sample # | Variable | Result 1 | Result 2 | CFU/Carton | Log | Log Red. |
|---|---|---|---|---|---|---|
| A1 | A | 380 | 330 | 355 | 2.6 | 4.02 |
| A2 | A | 320 | 330 | 325 | 2.5 | 4.06 |
| A3 | A | 40 | 80 | 60 | 1.8 | 4.79 |
| A4 | A | 120 | 200 | 160 | 2.2 | 4.37 |
| A5 | A | 70 | 40 | 55 | 1.7 | 4.83 |
| A6 | A | 140 | 120 | 130 | 2.1 | 4.46 |
| | | | | | Average | 4.42 |
| | | | | | Stdev | 0.35 |

TABLE EIGHT

| Variable B: | | | | | | | | |
|---|---|---|---|---|---|---|---|---|
| | 1 Pre-Heater | 2 H2O2 #1 | 3 Heater #2 | 4 H2O2 #2 | 5 Open | 6 H2O2 #3 | 7 Heater #3 | Tunnel Temp. |
| | 200 C | 190 C | 250 C | 190 C | — | 190 C | 250 C | 113–125 C |

Results:

| Sample # | Variable | Result 1 | Result 2 | CFU/Carton | Log | Log Red. |
|---|---|---|---|---|---|---|
| B1 | B | 10 | 10 | 10 | 1.0 | 5.57 |
| B2 | B | 130 | 130 | 130 | 2.1 | 4.46 |
| B3 | B | 30 | 40 | 35 | 1.5 | 5.03 |
| B4 | B | 200 | 270 | 235 | 2.4 | 4.20 |
| B5 | B | 80 | 30 | 55 | 1.7 | 4.83 |
| B6 | B | 100 | 130 | 115 | 2.1 | 4.51 |
| | | | | | Average | 4.77 |
| | | | | | Stdev | 0.49 |

EXAMPLE

For Example Three, two different variables of the apparatus and method are set forth in Tables Ten and Eleven. Table Nine illustrates the results for the Positive Control for Example Three.

TABLE NINE

Positive Controls:

| Sample # | Result 1 | Result 2 | Avg CFU/Carton | Log Average |
|---|---|---|---|---|
| PC1 | 5.00E + 06 | 3.20E + 06 | 4100000 | 6.61 |
| PC2 | 4.10E + 06 | 4.80E + 06 | 4450000 | 6.65 |

TABLE NINE-continued

Positive Controls:

| Sample # | Result 1 | Result 2 | Avg CFU/Carton | Log Average |
|---|---|---|---|---|
| PC3 | 4.70E + 06 | 5.60E + 06 | 5150000 | 6.71 |
| PC4 | 4.90E + 06 | 4.60E + 06 | 4750000 | 6.68 |
| PC5 | 5.10E + 06 | 3.90E + 06 | 4500000 | 6.65 |
| | | | Average | 6.66 |
| | | | Stdev | 0.04 |

TABLE TEN

| Variable A: Low end of parameter range - Heater air flows reduced. | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 184 C | 250 C AP = 135 | 184 C | | 184 C | 250 C AP = 328 |

Tunnel Temp. = 81–101 C
Pre-Breaker Air = 1.5 bar
H2O2 Flow = 0.4 l/hr
Residual Results: (6) 0.2, 0.3, 0.3, 1.0, 1.0, 1.0

| Sample # | Result 1 | Result 2 | Average CFU | Log | Log Reduction |
|---|---|---|---|---|---|
| A1 | 4.00E + 03 | 3.80E + 03 | 3900 | 3.59 | 3.07 |
| A2 | 2.20E + 02 | 1.90E + 02 | 205 | 2.31 | 4.35 |
| A3 | 5.80E + 02 | 4.60E + 02 | 520 | 2.72 | 3.94 |
| A4 | 2.70E + 02 | 2.20E + 02 | 245 | 2.39 | 4.27 |
| A5 | 1.00E + 02 | 1.60E + 02 | 130 | 2.11 | 4.55 |
| A6 | 1.34E + 03 | 1.10E + 03 | 1220 | 3.09 | 3.57 |
| A7 | — | — | — | — | — |
| A8 | 1.90E + 02 | 3.70E + 02 | 280 | 2.45 | 4.21 |
| A9 | 5.60E + 02 | 6.60E + 02 | 610 | 2.79 | 3.88 |
| A10 | 2.80E + 02 | 2.80E + 02 | 280 | 2.45 | 4.21 |
| | | | | Average | 4.01 |
| | | | | Stdev | 0.45 |

TABLE ELEVEN

| Variable B: Maximum Temperatures w/ heater air flows reduced. | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 300 C | 184 C | 300 C AP = 138 | 184 C | | 184 C | 330 C AP = 330 |

Tunnel Temp. = 91–106 C
Pre-Breaker Air = 1.5 bar
H2O2 Flow = 0.4 l/hr
Residual Results: (4) 0.2, 0.2, 0.3, 0.23

| Sample # | Result 1 | Result 2 | Average CFU | Log | Log Reduction |
|---|---|---|---|---|---|
| B1 | 1.00E + 02 | 7.00E + 01 | 85 | 1.93 | 4.73 |
| B2 | 1.00E + 02 | 1.30E + 02 | 115 | 2.06 | 4.60 |
| B3 | 3.20E + 02 | 2.50E + 02 | 285 | 2.45 | 4.21 |
| B4 | 2.40E + 02 | 3.00E + 02 | 270 | 2.43 | 4.23 |
| B5 | 3.30E + 02 | 4.10E + 02 | 370 | 2.57 | 4.09 |
| B6 | 1.60E + 02 | 3.10E + 02 | 235 | 2.37 | 4.29 |
| B7 | 3.90E + 02 | 3.80E + 02 | 385 | 2.59 | 4.08 |
| B8 | 2.90E + 02 | 1.30E + 02 | 210 | 2.32 | 4.34 |
| B9 | 2.30E + 02 | 2.20E + 02 | 225 | 2.35 | 4.31 |
| B10 | 1.90E + 02 | 1.70E + 02 | 180 | 2.26 | 4.41 |
| | | | | Average | 4.33 |
| | | | | Stdev | 0.21 |

EXAMPLE FOUR

For Example Four, four different variables of the apparatus and method are set forth in Tables Thirteen through Sixteen. Table Twelve illustrates the results for the Positive Control for Example Four.

TABLE NINE

| Positive Controls: | | | | |
|---|---|---|---|---|
| Sample # | Result 1 | Result 2 | Avg CFU/Carton | Log Average |
| PC1 | 4.40E + 06 | 3.80E + 06 | 4100000 | 6.61 |
| PC2 | 3.90E + 06 | 4.30E + 06 | 4100000 | 6.61 |
| PC3 | 4.50E + 06 | 4.40E + 06 | 4450000 | 6.65 |
| PC4 | 4.80E + 06 | 5.00E + 06 | 4900000 | 6.69 |
| PC5 | 4.60E + 06 | 4.90E + 06 | 4750000 | 6.68 |
| | | | Average | 6.65 |
| | | | Stdev | 0.04 |

TABLE THIRTEEN

| Variable A: | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C AP = 416 | 190 C | | 190 C | 250 C AP = 423 |

Tunnel Temp. = 116–122 C
Pre-Breaker Air = 1.5 bar
H2O2 Flow = 0.5 l/hr
Residual Results: (3) 0.1, 0.1, 0.1

| Sample # | Result 1 | Result 2 | Average CFU | Log | Log Reduction |
|---|---|---|---|---|---|
| A1 | 2.00E + 01 | 1.00E + 01 | 15 | 1.18 | 5.47 |
| A2 | 1.90E + 02 | 2.10E + 02 | 200 | 2.30 | 4.35 |
| A3 | 3.00E + 01 | 4.00E + 01 | 35 | 1.54 | 5.10 |
| A4 | 1.70E + 02 | 3.10E + 02 | 240 | 2.38 | 4.27 |
| A5 | 4.00E + 01 | 7.00E + 01 | 55 | 1.74 | 4.91 |
| A6 | 9.00E + 01 | 2.60E + 02 | 175 | 2.24 | 4.41 |
| A7 | 1.10E + 02 | 1.00E + 02 | 105 | 2.02 | 4.63 |
| A8 | 1.70E + 02 | 2.50E + 02 | 210 | 2.32 | 4.33 |
| A9 | 1.40E + 02 | 2.10E + 02 | 175 | 2.24 | 4.41 |
| A10 | 5.00E + 01 | 8.00E + 01 | 65 | 1.81 | 4.84 |
| | | | | Average | 4.67 |
| | | | | Stdev | 0.40 |

TABLE FOURTEEN

| Variable B: Flow rate at 0.4 l/hr | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C AP = 416 | 190 C | | 190 C | 250 C AP = 423 |

Tunnel Temp. = 120–122 C
Pre-Breaker Air = 1.5 bar
H2O2 Flow = 0.4 l/hr
Residual Results: (2) 0.1, 0.1

| Sample # | Result 1 | Result 2 | Average CFU | Log | Log Reduction |
|---|---|---|---|---|---|
| B1 | 2.80E + 02 | 4.00E + 02 | 340 | 2.53 | 4.12 |
| B2 | 5.00E + 02 | 4.20E + 02 | 460 | 2.66 | 3.99 |
| B3 | 3.60E + 02 | 3.00E + 02 | 330 | 2.52 | 4.13 |
| B4 | 3.00E + 02 | 3.70E + 02 | 335 | 2.53 | 4.12 |
| B5 | 3.00E + 02 | 3.50E + 02 | 325 | 2.51 | 4.14 |
| B6 | 3.00E + 02 | 3.10E + 02 | 305 | 2.48 | 4.16 |
| B7 | 2.20E + 02 | 2.00E + 02 | 210 | 2.32 | 4.33 |
| B8 | 3.30E + 02 | 2.10E + 02 | 270 | 2.43 | 4.22 |

TABLE FOURTEEN-continued

| Variable B: Flow rate at 0.4 l/hr | | | | | |
|---|---|---|---|---|---|
| B9 | 1.80E + 02 | 2.70E + 02 | 225 | 2.35 | 4.30 |
| B10 | 2.50E + 02 | 3.20E + 02 | 285 | 2.45 | 4.19 |
| | | | | Average | 4.17 |
| | | | | St dev | 0.10 |

TABLE FIFTEEN

| Variable C: Heater #3 Air Pressure Reduced to 330 | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C AP = 416 | 190 C | | 190 C | 250 C AP = 337 |

Tunnel Temp. = 124–128 C
Pre-Breaker Air = 1.5 bar
H2O2 Flow = 0.5 l/hr
Residual Results: (2) 0, 0

| Sample # | Result 1 | Result 2 | Average CFU | Log | Log Reduction |
|---|---|---|---|---|---|
| C1 | 9.00E + 01 | 1.00E + 02 | 95 | 1.98 | 4.67 |
| C2 | 5.00E + 01 | 3.00E + 01 | 40 | 1.60 | 5.05 |
| C3 | 2.30E + 02 | 2.50E + 02 | 240 | 2.38 | 4.27 |
| C4 | 6.00E + 01 | 3.00E + 01 | 45 | 1.65 | 4.99 |
| C5 | 3.50E + 02 | 2.50E + 02 | 300 | 2.48 | 4.17 |
| C6 | 4.00E + 01 | 1.00E + 02 | 70 | 1.85 | 4.80 |
| C7 | 2.10E + 02 | 3.10E + 02 | 260 | 2.41 | 4.23 |
| C8 | 1.50E + 02 | 1.50E + 02 | 150 | 2.18 | 4.47 |
| C9 | 2.20E + 02 | 1.90E + 02 | 205 | 2.31 | 4.34 |
| C10 | 2.40E + 02 | 1.10E + 02 | 175 | 2.24 | 4.41 |
| | | | | Average | 4.54 |
| | | | | Stdev | 0.32 |

TABLE SIXTEEN

| Variable D: Heater #2 Air Pressure Reduced to 160 | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C AP = 165 | 190 C | | 190 C | 250 C AP = 428 |

Tunnel Temp. = 103–125 C
Pre-Breaker Air = 1.5 bar
H2O2 Flow = 0.5 l/hr
Residual Results: (3) 0, 0.1, 0.1

| Sample # | Result 1 | Result 2 | Average CFU | Log | Log Reduction |
|---|---|---|---|---|---|
| D1 | 1.50E + 02 | 2.60E + 02 | 205 | 2.31 | 4.34 |
| D2 | 1.10E + 02 | 8.00E + 01 | 95 | 1.98 | 4.67 |
| D3 | 1.10E + 02 | 1.30E + 02 | 120 | 2.08 | 4.57 |
| D4 | 1.60E + 02 | 1.20E + 02 | 140 | 2.15 | 4.50 |
| D5 | 1.20E + 02 | 2.80E + 02 | 200 | 2.30 | 4.35 |
| D6 | 2.20E + 02 | 1.90E + 02 | 205 | 2.31 | 4.34 |
| D7 | 3.20E + 02 | 4.00E + 02 | 360 | 2.56 | 4.09 |
| D8 | 1.50E + 02 | 1.40E + 02 | 145 | 2.16 | 4.49 |
| D9 | 7.00E + 01 | 6.00E + 01 | 65 | 1.81 | 4.84 |
| D10 | 2.00E + 01 | 1.00E + 01 | 15 | 1.18 | 5.47 |
| | | | | Average | 4.56 |
| | | | | Stdev | 0.38 |

EXAMPLE FIVE

For Example Five, four different variables of the apparatus and method are set forth in Tables Eighteen through Twenty-one. Table Seventeen illustrates the results for the Positive Control for Example Five.

TABLE SEVENTEEN

| Positive Controls: | | | | |
|---|---|---|---|---|
| Sample # | Result 1 | Result 2 | Avg CFU/Carton | Log Average |
| PC1 | 4.10E + 05 | 6.50E+ 05 | 530000 | 5.72 |
| PC2 | 7.50E + 05 | 4.50E+ 05 | 600000 | 5.78 |

TABLE SEVENTEEN-continued

| Positive Controls: | | | | |
|---|---|---|---|---|
| Sample # | Result 1 | Result 2 | Avg CFU/Carton | Log Average |
| PC3 | 4.60E + 05 | 3.80E+ 05 | 420000 | 5.62 |
| PC4 | 6.10E + 05 | 7.30E+ 05 | 670000 | 5.83 |
| PC5 | 5.20E + 05 | 6.70E+ 05 | 595000 | 5.77 |
| | | | Average | 5.75 |
| | | | Stdev | 0.08 |

TABLE EIGHTEEN

| Variable A: | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C | 190 C | | 190 C | 250 C |
| | | AP = 294 | | | | AP = 499 |

Tunnel Temp. = 113–137 C (Recorded highest temp. in middle of running)
Pre-Breaker Air = 1.5 bar
H2O2 Flow = 0.5 l/hr
Residual Results: None

| Sample # | Result 1 | Result 2 | Average CFU | Log | Log Reduction |
|---|---|---|---|---|---|
| A1 | 1.00E + 01 | 1.00E + 01 | 10 | 1.00 | 4.75 |
| A2 | 6.00E + 01 | 9.00E + 01 | 75 | 1.88 | 3.87 |
| A3 | 1.00E + 01 | 4.00E + 01 | 25 | 1.40 | 4.35 |
| A4 | 1.00E + 02 | 3.00E + 01 | 65 | 1.81 | 3.93 |
| A5 | 7.00E + 01 | 2.00E + 01 | 45 | 1.65 | 4.09 |
| A6 | 3.00E + 01 | 4.00E + 01 | 35 | 1.54 | 4.20 |
| A7 | 4.00E + 01 | 2.00E + 01 | 30 | 1.48 | 4.27 |
| A8 | 0.00E + 00 | 0.00E + 00 | 0 | 0.00 | 5.75 |
| A9 | 3.00E + 01 | 1.00E + 01 | 20 | 1.30 | 4.44 |
| A10 | 0.00E + 00 | 0.00E + 00 | 0 | 0.00 | 5.75 |
| | | | | Average | 4.54 |
| | | | | Stdev | 0.68 |

TABLE NINETEEN

| Variable B: Larger flexible tubing & heater #3 300 C | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C | 190 C | | 190 C | 300 C |
| | | AP = 294 | | | | AP = 506 |

Tunnel Temp. = 115–151 C
Pre-Breaker Air = 1.5 bar
H2O2 Flow = 0.5 l/hr
Residual Results: None

| Sample # | Result 1 | Result 2 | Average CFU | Log | Log Reduction |
|---|---|---|---|---|---|
| B1 | 8.00E + 01 | 6.00E + 01 | 70 | 1.85 | 3.90 |
| B2 | 5.00E + 01 | 3.00E + 01 | 40 | 1.60 | 4.14 |

TABLE NINETEEN-continued

| Variable B: Larger flexible tubing & heater #3 300 C | | | | | |
|---|---|---|---|---|---|
| B3 | 1.00E + 01 | 0.00E + 00 | 5 | 0.70 | 5.05 |
| B4 | 3.00E + 01 | 2.00E + 01 | 25 | 1.40 | 4.35 |
| B5 | 9.00E + 01 | 3.00E + 01 | 60 | 1.78 | 3.97 |
| B6 | 2.00E + 01 | 0.00E + 00 | 10 | 1.00 | 4.75 |
| B7 | 5.00E + 01 | 2.00E + 01 | 35 | 1.54 | 4.20 |
| B8 | 1.10E + 02 | 9.00E + 01 | 100 | 2.00 | 3.75 |
| B9 | 7.00E + 01 | 2.00E + 01 | 45 | 1.65 | 4.09 |
| B10 | 8.00E + 01 | 7.00E + 01 | 75 | 1.88 | 3.87 |
| | | | | Average | 4.21 |
| | | | | Stdev | 0.41 |

TABLE TWENTY

| Variable C: Larger flexible tubing &H2O2 Temp 175 C | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 175 C | 250 C | 175 C | | 175 C | 250 C |
| | | AP = 294 | | | | AP = 499 |

Tunnel Temp. = 112–137 C
Pre-Breaker Air = 1.5 bar
H2O2 Flow = 0.5 l/hr
Residual Results: None

| Sample # | Result 1 | Result 2 | Average CFU | Log | Log Reduction |
|---|---|---|---|---|---|
| C1 | 7.00E + 01 | 1.20E + 02 | 95 | 1.98 | 3.77 |
| C2 | 8.00E + 01 | 1.10E + 02 | 95 | 1.98 | 3.77 |
| C3 | 1.00E + 02 | 9.00E + 01 | 95 | 1.98 | 3.77 |
| C4 | 1.90E + 02 | 2.00E + 02 | 195 | 2.29 | 3.46 |
| C5 | 7.00E + 01 | 2.00E + 02 | 135 | 2.13 | 3.61 |
| C6 | 2.30E + 02 | 1.80E + 02 | 205 | 2.31 | 3.43 |
| C7 | 3.00E + 01 | 3.00E + 01 | 30 | 1.48 | 4.27 |
| C8 | 9.00E + 01 | 9.00E + 01 | 90 | 1.95 | 3.79 |
| C9 | 8.00E + 01 | 3.00E + 01 | 55 | 1.74 | 4.00 |
| C10 | 1.10E + 02 | 6.00E + 01 | 85 | 1.93 | 3.82 |
| | | | | Average | 3.77 |
| | | | | Stdev | 0.25 |

TABLE TWENTY-ONE

| Variable D: Larger flexible tubing & H2O2 flow rate 0.6 l/hr | | | | | | |
|---|---|---|---|---|---|---|
| 1 Pre-heater | 2 H2O2 #1 | 3 Heater #2 | 4 H2O2 #2 | 5 OPEN | 6 H2O2 #3 | 7 Heater #3 |
| 200 C | 190 C | 250 C | 190 C | | 190 C | 250 C |
| | | AP = 294 | | | | AP = 500 |

Tunnel Temp. = 105–143 C
Pre-Breaker Air = 1.5 bar
H2O2 Flow = 0.6 l/hr
Residual Results: None

| Sample # | Result 1 | Result 2 | Average CFU | Log | Log Reduction |
|---|---|---|---|---|---|
| D1 | 3.00E + 01 | 1.00E + 01 | 20 | 1.30 | 4.44 |
| D2 | 1.00E + 01 | 0.00E + 00 | 5 | 0.70 | 5.05 |
| D3 | 3.00E + 01 | 1.00E + 01 | 20 | 1.30 | 4.44 |
| D4 | 4.00E + 01 | 0.00E + 00 | 20 | 1.30 | 4.44 |
| D5 | 0.00E + 00 | 0.00E + 00 | 0 | 0.00 | 5.75 |
| D6 | 1.00E + 01 | 1.00E + 01 | 10 | 1.00 | 4.75 |

TABLE TWENTY-ONE-continued

| Variable D: Larger flexible tubing & H2O2 flow rate 0.6 l/hr | | | | | |
|---|---|---|---|---|---|
| D7 | 0.00E + 00 | 0.00E + 00 | 0 | 0.00 | 5.75 |
| D8 | 0.00E + 00 | 0.00E + 00 | 0 | 0.00 | 5.75 |
| D9 | 0.00E + 00 | 0.00E + 00 | 0 | 0.00 | 5.75 |
| D10 | 0.00E + 00 | 0.00E + 00 | 0 | 0.00 | 5.75 |
| | | | | Average | 5.19 |
| | | | | Stdev | 0.62 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claims as our invention:

1. A method for sterilizing a series of containers being processed on a multiple station form, fill and seal packaging machine, each of the containers partially formed and defining a hollow interior, the method comprising:

moving each of the containers into a sterilization tunnel, the tunnel maintained at a temperature of at least about 60° C. to maintain the sterilization tunnel at a temperature above the condensation temperature of hydrogen peroxide;

subjecting each of the partially formed containers to a first predetermined quantity of gas-phase hydrogen peroxide from a first gas nozzle within the sterilization tunnel thereby subjecting the interior and the exposed exterior of each of the partially formed containers to the gas-phase hydrogen peroxide, the gas-phase hydrogen peroxide being at a concentration of at least about 35 percent;

heating each of the partially formed containers with air heated at a first predetermined temperature at a position subsequent to the gas-phase application of hydrogen peroxide inside the sterilization tunnel;

subjecting each of the partially formed containers to a second predetermined quantity of gas-phase hydrogen peroxide from a second gas nozzle within the sterilization tunnel at a position subsequent to the first gas nozzle, the gas-phase hydrogen peroxide being at a concentration of at least about 35 percent;

subjecting each of the partially formed containers to a third predetermined quantity of gas-phase hydrogen peroxide from a third gas nozzle within the sterilization tunnel at a position subsequent to the second gas nozzle, the gas-phase hydrogen peroxide being at a concentration of at least about 35 percent; and heating each of the partially formed containers with air heated at a second predetermined temperature at a position subsequent to third gas nozzle.

2. The method according to claim 1 further comprising filling each of the partially formed containers at a position subsequent to the sterilization tunnel.

3. The method according to claim 1 further comprising heating each of the partially formed containers prior to moving each of the partially formed containers into the sterilization tunnel.

4. The method according to claim 1 wherein each of the partially formed containers have a fitment disposed thereon whereby the exposed positions of the fitment are sterilized with the sterilization of each of the partially formed containers.

5. The method according to claim 1 wherein the gas-phase hydrogen peroxide has a concentration lower than 53%.

6. The method according to claim 1 further comprising maintaining the sterilization tunnel at a temperature between 40° C. and 150° C.

7. The method according to claim 1 further comprising transforming to the gas phase a solution of hydrogen peroxide having a concentration less than 53% prior to subjecting each of the partially formed containers to a predetermined quantity of gas-phase hydrogen peroxide.

8. The method according to claim 1 further comprising flowing sterile air into the sterilization tunnel.

9. An apparatus for sterilizing a series of containers being processed on a multiple station form, fill and seal packaging machine, each of the containers partially formed and defining a hollow interior, the apparatus comprising:

a conveyor assembly for moving each of the partially formed containers along the packaging machine at a predetermined interval;

a sterilization tunnel encompassing a portion of the conveyor assembly, the sterilization tunnel having an ingress and an egress;

a first gas nozzle disposed above the conveyor assembly within the sterilization tunnel, the first gas nozzle emitting a gas-phase hydrogen peroxide having a concentration of at least about 35 percent;

a first heater disposed above the conveyor assembly, within the sterilization tunnel and adjacent the first gas nozzle;

a second gas nozzle disposed above the conveyor assembly within the sterilization tunnel and subsequent to the first gas nozzle, the second gas nozzle emitting a gas-phase hydrogen peroxide having a concentration of at least about 35 percent;

a third gas nozzle disposed above the conveyor assembly within the sterilization tunnel and subsequent to the second gas nozzle, the second gas nozzle emitting a gas-phase hydrogen peroxide having a concentration of at least about 35 percent; and a second heater disposed above the conveyor assembly, within the sterilization tunnel and adjacent the egress to the tunnel, the first and second heaters maintaining the sterilization tunnel at a temperature of at least about 60° C. to maintain the sterilization tunnel above a condensation temperature of hydrogen peroxide at the concentration at which it is emitted into the sterilization tunnel.

10. The apparatus according to claim 9 further comprising a pre-heater disposed outside of and prior to the ingress of the sterilization tunnel.

11. The apparatus according to claim 9 wherein the gas-phase hydrogen peroxide has a concentration lower than 53%.

12. The apparatus according to claim 9 further comprising means for maintaining the sterilization tunnel at a temperature between 40° C. and 150° C.

13. The apparatus according to claim 9 further comprising means for transforming to the gas phase a solution of hydrogen peroxide having a concentration less than 53%, the transforming means in flow communication with at least one of the gas nozzles.

14. The apparatus according to claim 9 further comprising means for flowing sterile air into the sterilization tunnel.

15. A linear form, fill and seal packaging machine for producing a high acid ambient distribution product in a container, the packaging machine open to the environment comprising:

a conveyor assembly for transporting the containers along the packaging machine;

a sterilization tunnel encompassing a portion of the conveyor assembly, the sterilization tunnel having an ingress and an egress;

a plurality of gas nozzles disposed above the conveyor assembly within the sterilization tunnel, each of the plurality of gas nozzles emitting a gas-phase hydrogen peroxide having a concentration of at least about 35 percent;

a plurality of heaters disposed above the conveyor assembly within the sterilization tunnel, each of the plurality of heaters emitting hot air and maintaining the sterilization tunnel at a temperature of at least about 60° C. to maintain the sterilization tunnel above a condensation temperature of the gas-phase hydrogen peroxide at the concentration at which it is emitted into the sterilization tunnel; and a filling station for filling a high acid product into a carton.

16. The packaging machine according to claim 15 further comprising a pre-heater disposed outside of and prior to the ingress of the sterilization tunnel.

17. The packaging machine according to claim 15 wherein the gas-phase hydrogen peroxide has a concentration lower than 53%.

18. The packaging machine according to claim 15 further comprising means for maintaining the sterilization tunnel at a temperature between 40° C. and 150° C.

19. The packaging machine according to claim 15 further comprising means for transforming to the gas phase a solution of hydrogen peroxide having a concentration less than 53%, the transforming means in flow communication with at least one of the gas nozzles.

20. The packaging machine according to claim 15 further comprising means for flowing sterile air into the sterilization tunnel.

21. The packaging machine according to claim 15 wherein the packaging machine is not substantially enclosed from its environment.

* * * * *